US009420858B2

(12) United States Patent
Rafaelian

(10) Patent No.: US 9,420,858 B2
(45) Date of Patent: Aug. 23, 2016

(54) ADJUSTABLE JEWELRY

(71) Applicant: Alex and Ani, LLC, Cranston, RI (US)

(72) Inventor: Carolyn A. Rafaelian, Cranston, RI (US)

(73) Assignee: Alex and Ani, LLC, Cranston, RI (US)

( * ) Notice: Subject to any disclaimer, the term of this patent is extended or adjusted under 35 U.S.C. 154(b) by 46 days.

(21) Appl. No.: 14/271,354

(22) Filed: May 6, 2014

(65) Prior Publication Data

US 2015/0320152 A1 Nov. 12, 2015

(51) Int. Cl.

| | |
|---|---|
| ***A44C 5/22*** | (2006.01) |
| ***A44C 15/00*** | (2006.01) |
| ***A44C 5/00*** | (2006.01) |

(52) U.S. Cl.

CPC ..... *A44C 5/22* (2013.01); *A44C 5/0069* (2013.01); *A44C 15/005* (2013.01)

(58) Field of Classification Search

None

See application file for complete search history.

(56) References Cited

U.S. PATENT DOCUMENTS

| | | | | |
|---|---|---|---|---|
| 118,294 | A * | 8/1871 | Steven | A44C 5/00 24/115 H |
| 434,220 | A * | 8/1890 | Whitney | A44C 5/0092 63/11 |
| 2,289,802 | A * | 7/1942 | Norton | A01K 27/001 119/793 |
| 2,859,732 | A * | 11/1958 | Driscoll | A01K 27/001 119/864 |
| 4,321,804 | A * | 3/1982 | Borofsky | A44C 11/005 24/115 H |
| D658,089 | S | 4/2012 | Rafaelian | |
| 2006/0096552 | A1* | 5/2006 | Cheng Yin Tsai | A01K 27/001 119/863 |
| 2009/0019889 | A1 | 1/2009 | Smith | |
| 2011/0314866 | A1* | 12/2011 | Niikura | A44C 15/005 63/3.2 |
| 2012/0192384 | A1 | 8/2012 | Kelly | |
| 2014/0090215 | A1 | 4/2014 | Lixenberg | |

FOREIGN PATENT DOCUMENTS

| | | | | |
|---|---|---|---|---|
| GB | 2122873 | A1 * | 1/1984 | A44C 11/005 |
| JP | 2000-287723 | A | 10/2000 | |

OTHER PUBLICATIONS

International Search Report and Written Opinion mailed Aug. 31, 2015 in connection with International Application No. PCT/US2015/029368.

* cited by examiner

*Primary Examiner* — Jack W Lavinder

(74) *Attorney, Agent, or Firm* — Wolf, Greenfield & Sacks, P.C.

(57) ABSTRACT

The herein described jewelry article includes, in one aspect, a flexible member having a first end and a second end. The first end of the flexible member is fixedly secured to a connector. The flexible member is also slidably secured to the connector at a point along its length so a first portion of the flexible member extends between connection points. The jewelry article also includes an adjustment mechanism that defines a channel through which the first portion of the flexible member and the second end of the flexible member extends thereby allowing a length of the first portion to be selectively adjusted.

31 Claims, 4 Drawing Sheets

ADJUSTABLE JEWELRY

BACKGROUND OF THE DISCLOSURE

1. Field of the Disclosure

This disclosure generally relates to jewelry, more specifically to jewelry articles, such as bracelets, necklaces, and the like, which can be adjusted to account for different sizes.

2. Background of the Related Art

Jewelry articles, such as bands, can include features that allow their size to be adjusted or modified to suit the preference of the wearer. Traditionally, such adjustable bands have included multiple segments joined together by an adjustment feature or mechanism.

For example, the adjustable jewelry article disclosed in U.S. Pat. No. 6,202,443 to Grosser-Samuels includes a complex adjustment mechanism having springs and buttons. In another example, the jewelry article described in U.S. Patent Publication No. 2007/0022778 to Ferlise includes multiple adjustment features, chains, and ornamental features which add complexity to the article especially when attempting to adjust its size.

Having multiple band pieces and/or complex adjustment features increases the manufacturing cost of the jewelry article and reduces the robustness and usability of the band.

Accordingly, there is a need for simpler, user-friendly adjustable jewelry and/or multifunctional adjustable jewelry that can be easily modified for size and/or aesthetics to suit the wearer.

SUMMARY OF THE DISCLOSURE

The purpose and advantages of the disclosure will be set forth in and will be apparent from the description that follows. Additional advantages of the invention will be realized and attained by the systems and methods particularly pointed out in the written description and claims hereof, as well as from the appended drawings.

To achieve these and other advantages and in accordance with the purpose of this disclosure, the herein described jewelry article includes, in one aspect, a flexible member that has a first end and a second end. The first end of the flexible member is fixedly secured to a connector. The flexible member is also slidably secured through the connector at a point along its length so a first portion of the flexible member extends between connection points.

The jewelry article also includes an adjustment mechanism that defines a channel through which the first portion of the flexible member and the second end of the flexible member extends thereby allowing a length of the first portion to be selectively adjusted.

In certain embodiments, the connector can include a single ring such that the first end is connected to the single ring and the length of the flexible member passes through the single ring to be slidably secured to the single ring. In some embodiments, the connector can include an ornamental element with one or more connection points.

The connector can define at least one aperture. The flexible member can be slidably secured to the connector by passing the flexible member through the at least one aperture. In some embodiments, the connector defines at least two apertures.

A first ring can be used to fixedly secure the first end of the flexible member to the first aperture formed in the connector. A second ring can be used to slidably secure the flexible member to the connector along its length.

The channel formed in the adjustment mechanism can be adapted and configured for frictionally restraining movement of the flexible member within the channel.

In a further aspect of this disclosure, an adjustable jewelry article can include, inter alia, a flexible member having opposed first and second ends, a connector connected to or defining at least one of a first and a second ring. The first end of the flexible member can be connected to the first ring and the second end of the member is free. The flexible member passes through the second ring such that there is a first portion of the member that is defined between the first end and the second ring and a second portion of the member is defined after passing through the second ring. An adjustment device is connected to the first portion of the flexible member and the second portion of the flexible member such that the length of the first portion of the flexible member can be selectively modified to adjust the wearable size of the flexible member.

Preferably, the second end of the flexible member includes a stop feature disposed thereon to prevent the second end from passing through the channel formed in the adjustment device.

It is envisioned that the flexible member can include a wire, chain, cord, or any other suitable composition. In some embodiments, the flexible member includes a leather band. In other embodiments, the flexible member includes a plastic band.

The adjustment device can be a bead which defines a friction cavity or chamber, wherein the friction cavity can include a material which is adapted and configured to resists motion of the first portion of the flexible member and the second portion of the flexible member within the bead channel. The friction cavity allows the first portion of the flexible member and the second portion of the flexible member to be selectively slid through the bead when a force sufficient to overcome a frictional force provided by the frictional material is applied thereto.

The frictional material can include a semi-rigid material disposed within the cavity or channel on the inner surface of the bead. In some embodiments, the frictional material includes a rubber and/or a plastic. Preferably, the frictional material is silicone. It is envisioned that the frictional material can define a single hole/passageway for both of the first and second portions of the flexible member to pass therethrough.

In other embodiments, the frictional material defines a first hole for the first portion of the flexible member to pass therethrough and a second hole for the second portion of the flexible member to pass therethrough. It is envisioned that the first ring and the second ring can be a single ring.

Still further, the present disclosure is also directed to an article of jewelry that includes a chain having opposed first and second ends, a connector, and an adjustment bead. The first end of the chain is fixedly secured to the connector and the chain is also slidably secured to the connector along a length of the chain length such that a first portion of the chain extends between connection points. The adjustment bead defines a channel through which the first portion of the chain and the second end of the chain extends. The adjustment bead is adapted and configured for allowing a length of the first portion to be selectively adjusted.

In some embodiments, the connection points include one or more jump rings.

BRIEF DESCRIPTION OF THE DRAWINGS

So that those having ordinary skill in the art to which the invention pertains will more readily understand how to employ the jewelry articles of the present invention, embodiments thereof will be described in detail hereinbelow with reference to the drawings, wherein.

Figure 1:
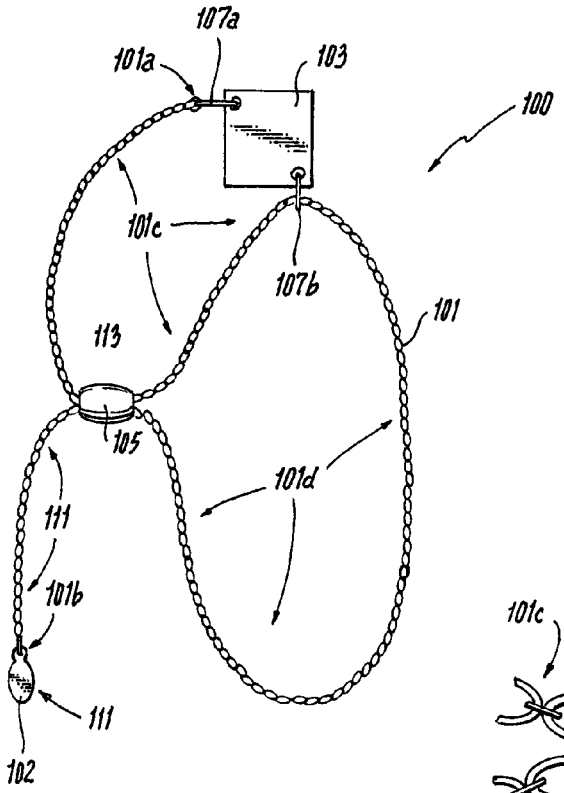
FIG. 1 illustrates a top plan view of an embodiment of a jewelry article which has been constructed in accordance with this disclosure.

These and other aspects of the subject disclosure will become more readily apparent to those having ordinary skill in the art from the following detailed description of the invention taken in conjunction with the drawings.

DETAILED DESCRIPTION OF CERTAIN EMBODIMENTS

Embodiments of this disclosure are now described more fully with reference to the accompanying drawings, in which an illustrated embodiment is shown. This disclosure is not limited in any way to the illustrated embodiment as the illustrated embodiments described below are merely an example which can be embodied in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the embodiments disclosed herein. Furthermore, the terms and phrases used herein are not intended to be limiting but rather to provide an understandable description of the embodiments herein.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in this disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the disclosed embodiments, exemplary methods and materials are now described. All publications mentioned herein are incorporated herein by reference to disclose and describe the methods and/or materials in connection with which the publications are cited.

The present disclosure generally relates to adjustable articles of jewelry.

Turning now descriptively to the drawings, in which similar reference characters denote similar elements throughout the several views, FIGS. 1-6 generally depict a jewelry article which has been constructed in accordance with an embodiment of the present invention and designated by reference numeral 100.

In at least one aspect of this disclosure, the item of jewelry 100 includes a flexible member 101 that has a first end 101*a* and a second end 101*b*. The flexible member 101 can be any suitable band (e.g., chain, rope, wire, cord, and/or the like) and can be a single strand. In some embodiments, the flexible member 101 can include a metal chain as shown in FIGS. 1-6. In some embodiments, the flexible member 101 can include a leather band and/or any other suitable material. In some embodiments, the flexible member 101 can include a plastic band. It is contemplated that differing materials can be linked together to form a flexible member 101 as disclosed herein.

A connector 103 can be connected to and/or defines at least one of a first ring 107*a* and a second ring 107*b*. As shown, the connector 103 defines one or more apertures in which rings 107*a*, 107*b* are looped through. While the connector 103 is shown as an ornamental element in FIG. 1, it would be understood by one having ordinary skill in the art that the connector 103 can include any suitable shape, size, or design such that a first end 101*a* of the flexible member 101 is attached to a portion of the connector 103 and a portion of the flexible member 101 is also slidably connected to the connector 103.

As shown in FIG. 1, the first end 101*a* of the flexible member 101 is connected to the first ring 107*a*. While it is shown that the first end 101*a* is connected to ring 107*a*, ring 107*a* can be removed and the first end 101*a* can be fixed to the aperture formed or defined in the connector 103.

The second end 101*b* of the flexible member 101 is free and not rigidly connected to the connector 103. However, the flexible member 101 passes through the second ring 107*b* such that there is a first portion 101*c* of the flexible member 101 that is defined before passing through the second ring 107*b* and a second portion 101*d* that is defined after passing through the second ring 107*b*. While it is shown that the flexible member 101 passes through ring 107*b*, ring 107*b* can be removed and the flexible member 101 can pass through the aperture in the connector 103.

In some embodiments, the first ring 107*a* and the second ring 107*b* can be a single ring/aperture such that the flexible member 101 passes through the same hole in which the first end of the flexible member 101 is connected to.

The article of jewelry 100 further includes an adjustment device 105 connecting the first portion 101*c* of the flexible member 101 and the second portion 101*d* of the flexible member 101 such that the length of the first portion 101*c* of the flexible member 101 can be selectively modified to adjust the wearable size (e.g., area of space 113) of the flexible member 101. This allows the flexible member 101 to fit on wrists, necks, fingers, waists, ankles, or other bodily portions of varying size and/or to the wearer's preference. Also, the length of the flexible member 101 can be modified to allow the jewelry to fit around any suitable body portion (e.g., wrists, necks, fingers, waists, ankles, or other bodily portions).

Also, the article of jewelry 100 includes a dual functionality. The aesthetic appearance of article 100 can be modified by changing the position of the adjustment device 105 and/or by pulling on feature 111. This can occur without changing the size of the article of jewelry 100 or while modifying its size.

As shown in FIG. 1, the second end 101*b* can include a stop feature (e.g., tag 102) disposed thereon to prevent the second end 101*b* from passing through the adjustment device 105 and/or the second ring 107*b*.

Figure 2:
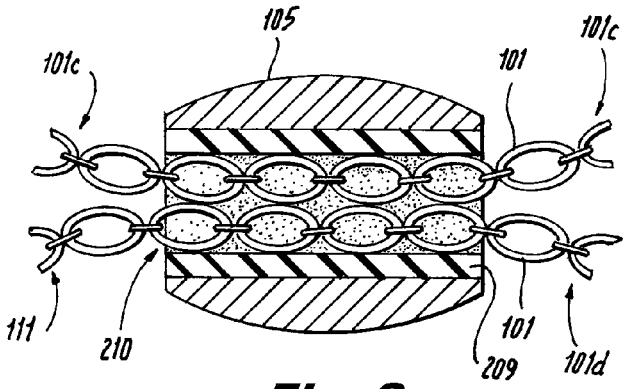
FIG. 2 illustrates a side, cross-sectional view of an embodiment of an adjustment device constructed in accordance with this disclosure.
Figure 3A:
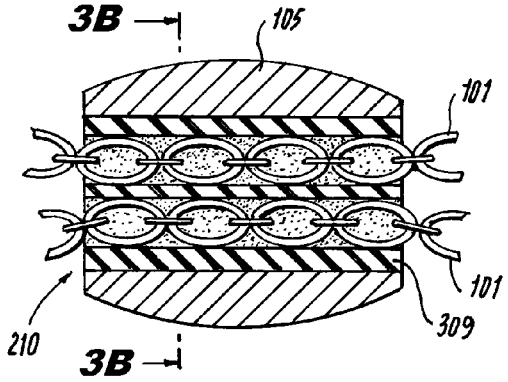
FIG. 3A illustrates a side, cross-sectional view of another embodiment of an adjustment device constructed in accordance with this disclosure.
Figure 3B:
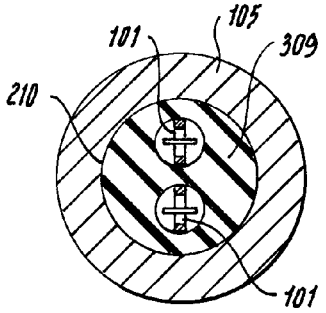
FIG. 3B illustrates a front, cross-sectional view of the adjustment device of FIG. 3.

Referring additionally to FIGS. 2-3B, the adjustment device 105 can be a bead defining a friction cavity 210 such that the friction cavity 210 restrains the first portion 101*c* of the flexible member 101 and the second portion 101*d* of the flexible member 101 within the bead using a frictional material 209, 309. As shown in FIG. 2, the frictional material 209 can be disposed within the friction cavity 210 and define a single cavity therethrough for both lengths of flexible member 101 to pass through. As shown FIG. 3, the frictional material 309 can define a cavity for each portion of flexible member 101 passing therethrough. The frictional material 209, 309 can include any suitable features to prevent or inhibit the flexible member 101 from slipping through the adjustment device 105 unintentionally.

The friction cavity 210 can allow the first portion 101*c* of the flexible member 101 and the second portion 101*d* of the flexible member 101 to be selectively slid through the adjustment device 105 when a force sufficient to overcome a frictional force provided by the frictional material 209, 309 is applied thereto.

The frictional material 209, 309 can include any suitable semi-rigid material (e.g., a polymer, silicone, cork, etc.) disposed on the inner surface of the adjustment device 105. In some embodiments, the frictional material 209, 309 can include a rubber and/or a plastic.

Figure 4:
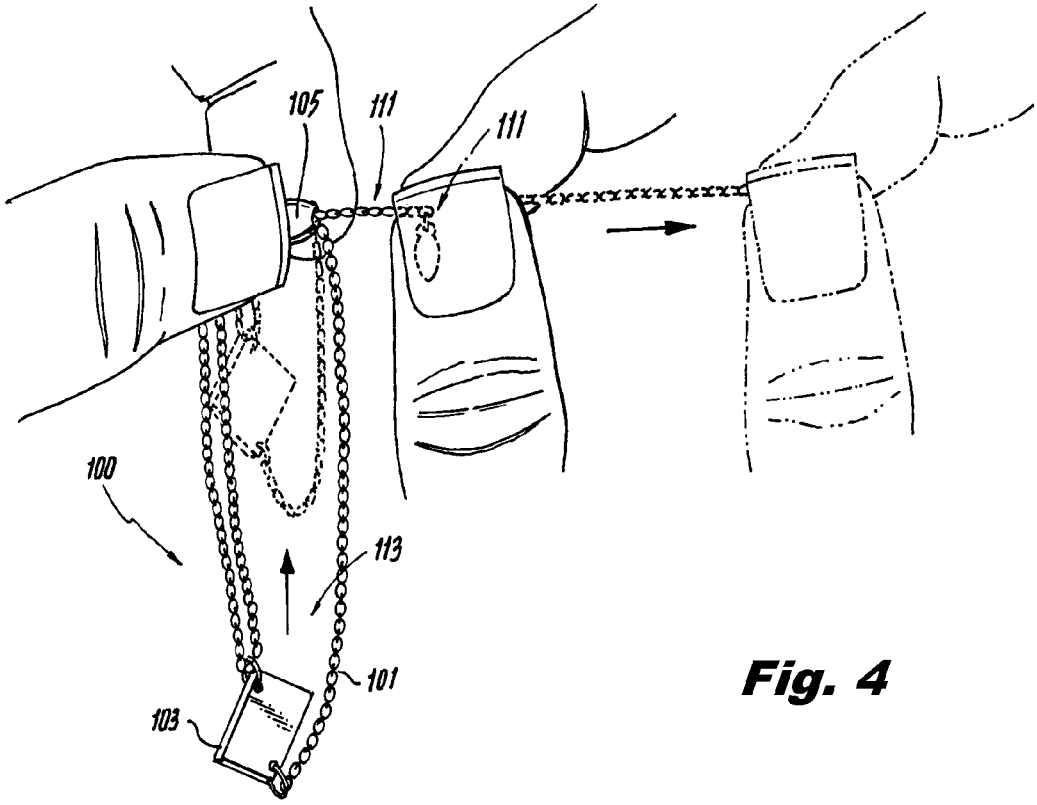
FIG. 4 illustrates a method for adjusting the size of the jewelry article of FIG. 1.
Figure 5:
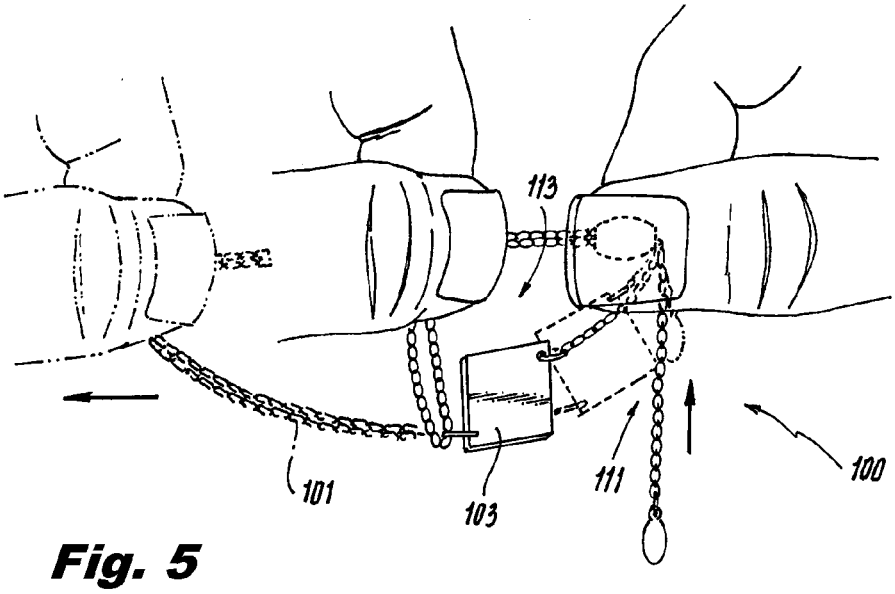
FIG. 5 illustrates another method for adjusting an aesthetic feature of the jewelry article of FIG. 1.

Referring additionally to FIGS. 4 and 5, dual functionality of the item of jewelry 100 is depicted. As shown in FIG. 4, a size (e.g., area of space 113) of the flexible member 101 can be modified (e.g., reduced) by modifying the length of the aesthetic portion 111 (e.g., by pulling on the aesthetic portion 111 while holding the adjustment device 105). Alternatively, an aesthetic portion 111 can be modified (e.g., reduced in length) without modifying the size of flexible member 101 by gripping the adjustment device and the second portion 101*d* and first portions 101*c* (or the aesthetic portion 111 and the first portion 101*c*) of the flexible member 101 as shown in FIG. 5.

Figure 6:
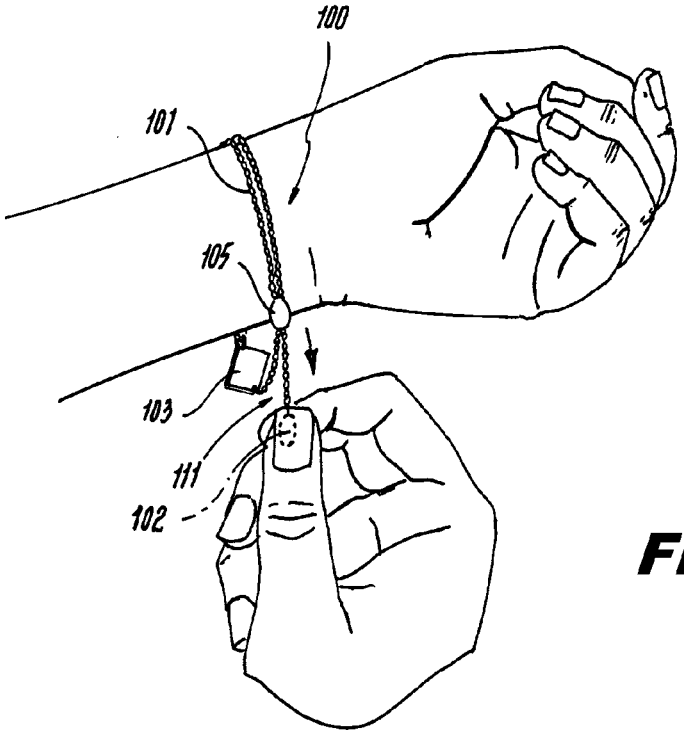
FIG. 6 illustrates a method for adjusting the size of the jewelry article of FIG. 1 while being worn by a user.

Referring to FIG. 6, an in-situ size adjustment is depicted. A wearer can pull on the aesthetic portion 111 when the jewelry 100 is on a portion of their body (e.g., wrist as shown). By pulling the aesthetic portion 111, the size of the flexible member 101 around the wrist is reduced and the length of the aesthetic portion in increased. If the wearer wishes to reduce the length of the aesthetic portion 111 after such a size adjustment, the wearer can move the adjustment device 105 toward the second end 101*b* of the flexible member 101.

Accordingly, the item of jewelry 100 can provide both size adjustment and aesthetic adjustment as the wearer desires. For example, some users may want to increase and/or maximize the length of the aesthetic portion 111 by fitting the flexible member 101 to their wrist or neck and then sliding the adjustment device 105 toward the second ring 107*b*. Some users may want to shorten or eliminate any extra length to the aesthetic portion 111 such that the stop feature (e.g., tag 102) contacts the adjustment device 105 which can be accomplished by sliding the adjustment device 105 toward the stop. In both cases, aesthetics and size can be adjusted independently of each other (at least up to the maximum size limitations of the flexible member 101).

Figure 7:
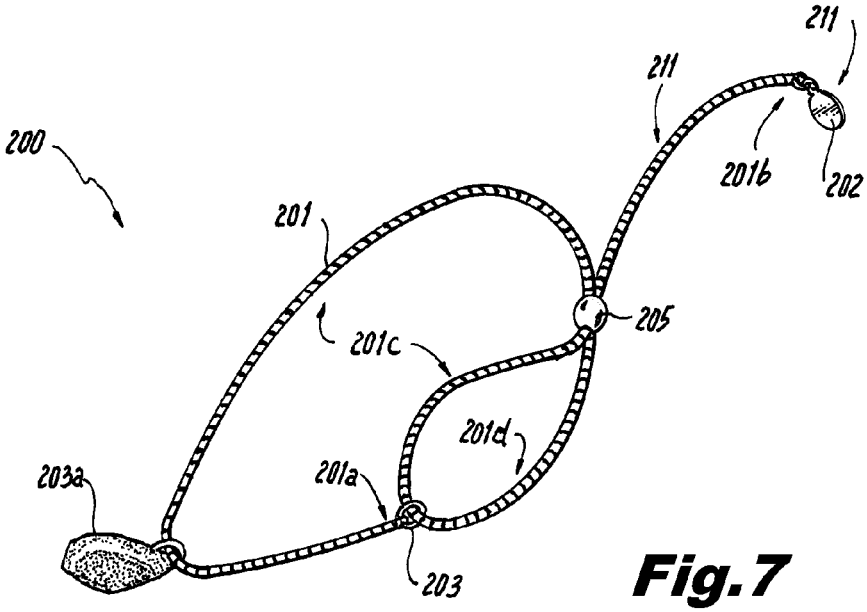
FIG. 7 illustrates a perspective view of another embodiment of a jewelry article which has been constructed in accordance with this disclosure.

Another embodiment of an article of jewelry 200 with similar function to the article of jewelry 100 is shown in FIG. 7. As shown, the connector 203 can include a single ring to which a first end 201*a* of a flexible member 201 is fixedly connected. Similar to the above described embodiments, the second end 201*b* of the flexible member 201 is free and not rigidly connected to the connector 203. However, the flexible member 201 passes through the connector 203 such that there is a first portion 201*c* of the flexible member 201 that is defined before passing through connector 203 and a second portion 201*d* that is defined after passing through the connector 203.

Another embodiment of an article of jewelry 200 with similar function to the article of jewelry 100 is shown in FIG. 7. As shown, the connector 203 can include a single ring to which a first end 201*a* of a flexible member 201 is fixedly connected.

Similar to the above described embodiments, the second end 201*b* of the flexible member 201 is free and not rigidly connected to the connector 203. However, the flexible member 201 passes through the connector 203 such that there is a first portion 201*c* of the flexible member 201 that is defined before passing through connector 203 and a second portion 201*d* that is defined after passing through the connector 203.

The article of jewelry 200 further includes an adjustment device 205, an aesthetic portion 211, and a stop member 202 similar to those as described above with reference to the article of jewelry 100 shown in FIG. 1. Also, as shown, an ornamental element 203*a* can be disposed on the flexible member 201 in any suitable place.

Figure 8:
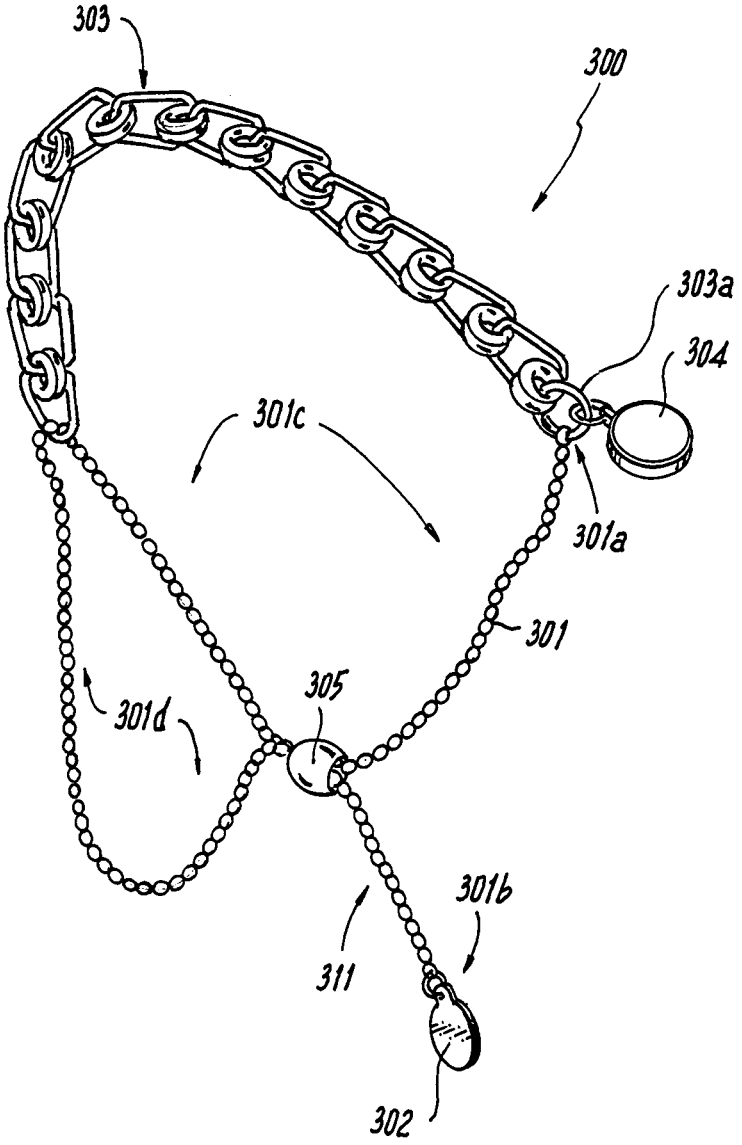
FIG. 8 illustrates a perspective view of yet another embodiment of a jewelry article which has been constructed in accordance with this disclosure.

Another embodiment of an article of jewelry 300 with similar function to the article of jewelry 100 is shown in FIG. 8. As shown, the connector 303 can include a chain or other suitable motif to which a first end 301*a* of a flexible member 301 is fixedly connected. As shown, the first end 301*a* is connected to a jump ring 303*a* attached to the connector 303, however, it is contemplated that the first end 301*a* can be connected directly to the connector 303.

Similar to the above described embodiments, the second end 301*b* of the flexible member 301 is free and not rigidly connected to the connector 303. However, the flexible member 301 passes through the connector 303 such that there is a first portion 301*c* of the flexible member 301 that is defined before passing through connector 303 and a second portion 301*d* that is defined after passing through the connector 303.

The article of jewelry 300 further includes an adjustment device 305, an aesthetic portion 311, and a stop member 302 similar to those as described above with reference to the article of jewelry 100 shown in FIG. 1. Also, as shown, an ornamental element 304 can be disposed on the flexible member 301 in any suitable place, the connector 303, and/or jump ring 303*a*.

The descriptions above and the accompanying drawings should be interpreted in the illustrative and not the limited sense. While the invention has been disclosed in connection with the embodiments disclosed herein, it should be understood that there may be other embodiments which fall within the scope of this disclosure and the following claims. Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. An adjustable jewelry article, comprising:

a flexible band having a first end and a dangling, second end;

a connector, the first end of the flexible band being fixedly secured to the connector at a fixed connection, a portion of the flexible band also being slidably secured through the connector at a slidable connection to define a variably sized wearable loop of the flexible band that extends between the fixed connection and the slidable connection;

an adjustment device defining a channel through which both the variably sized wearable loop and a portion of the flexible band proximal of the dangling, second end are both slidable; and a frictional material disposed within the channel, the channel and the frictional material being adapted and configured for frictionally restraining movement of the flexible band within the channel, wherein pulling of the dangling, second end away from the adjustment device reduces the size of the variably sized wearable loop.

2. The jewelry article of claim 1, wherein the connector comprises a single ring such that the first end is connected to the single ring and a length of the flexible band is slidably passable through the single ring.

3. The jewelry article of claim 1, wherein the connector includes an ornamental element having at least one aperture or ring.

4. The jewelry article of claim 1, wherein the connector defines at least one aperture.

5. The jewelry article of claim 4, wherein the flexible band is slidably secured to the connector by passing the flexible band through the at least one aperture.

6. The jewelry article of claim 5, wherein the connector defines at least two apertures.

7. The jewelry article of claim 6, further comprising a first ring which is fixedly secured to the first aperture, the first end of the flexible band being secured to the first ring.

8. The jewelry article of claim 7, further comprising a second ring which slidably secures the flexible band to the connector along its length.

9. An adjustable jewelry article, comprising:

a flexible band having first and second ends;

a connector including a first ring and a second ring, wherein the first end of the flexible band is fixedly connected to the first ring, wherein the band passes through the second ring such that there is a first portion of the band that is defined before passing through the second ring and a second portion that is defined after passing through the second ring, the second end of the band being free and allowed to move in any direction relative to the first portion of the band;

an adjustment device defining a channel through which the first portion of the band and the second portion of the band are both slidable, the adjustment device connecting the first portion of the band and the second portion of the band, wherein the free, second end of the band is not directly attached either to the connector or to the adjustment device, and wherein the length of the first portion of the band can be selectively reduced by pulling on the free, second end to reduce a wearable size of the band; and a frictional material disposed within the channel, the channel and the frictional material being adapted and configured for frictionally restraining movement of the flexible band within the channel.

10. The jewelry article of claim 9, wherein the second end of the flexible band includes a stop feature disposed thereon to prevent the second end from passing through the channel formed in the adjustment device.

11. The jewelry article of claim 9, wherein the flexible band comprises a wire, chain, or cord.

12. The jewelry article of claim 9, wherein the flexible band comprises a leather band.

13. The jewelry article of claim 9, wherein the flexible band comprises a plastic band.

14. The jewelry article of claim 9, wherein the adjustment device is a bead.

15. The jewelry article of claim 9, wherein the frictional material comprises a semi-rigid material.

16. The jewelry article of claim 15, wherein the frictional material comprises a rubber.

17. The jewelry article of claim 15, wherein the frictional material comprises a plastic.

18. The jewelry article of claim 15, wherein the frictional material comprises a rubber and a plastic.

19. The jewelry article of claim 15, wherein the frictional material comprises silicone.

20. The jewelry article of claim 9, wherein the frictional material defines a single hole for both of the first and second portions of the flexible band to pass therethrough.

21. The jewelry article of claim 9, wherein the frictional material defines a first hole for the first portion of the flexible band to pass therethrough and a second hole for the second portion of the flexible band to pass therethrough.

22. The jewelry article of claim 9, wherein the connector is a chain and includes a first ring at one portion of the chain and a second ring at another portion of the chain.

23. An adjustable jewelry article, comprising:

a flexible band having a first end and a second end, the flexible band forming a first variably sized loop and a distinct second variably sized loop, a first portion of the first variably sized loop and a second portion of the second variably sized loop being the same portion of the flexible band;

a connector providing a fixed connection and a slidable connection, the first end of the flexible band being fixedly secured to the fixed connection and a segment of the flexible band between the first end and the second end being slidably connected to the slidable connection; and an adjustment device to releasably retain the first variably sized loop and the second variably sized loop;

wherein, the second end of the flexible band is a free end that is not connected directly either to the adjustment device or to the connector, and the free second end extends from one side of the adjustment device and the second variably sized loop extends from another side of the adjustment device, the free end being movable selectively away from the adjustment device to reduce the size of the second variably sized loop.

24. The jewelry article of claim 23, wherein reducing the size of the second variably sized loop in turn reduces the size of the first variably sized loop.

25. The jewelry article of claim 23, wherein the fixed connection includes a ring.

26. The jewelry article of claim 25, wherein the slidable connection includes a ring.

27. The jewelry article of claim 26, wherein the fixed connection and the slidable connection include the same ring.

28. The jewelry article of claim 26, wherein the connector includes a chain attached to the first ring and to the second ring.

29. The jewelry article of claim 23, wherein the connector includes a first aperture.

30. The jewelry article of claim 29, wherein the connector further includes a second aperture.

31. The jewelry article of claim 23, wherein the adjustment device includes a bead defining a friction cavity.

* * * * *